US010276957B2

(12) United States Patent
Wright et al.

(10) Patent No.: US 10,276,957 B2
(45) Date of Patent: Apr. 30, 2019

(54) GROUNDING METHOD FOR BASEPLATE SEALED ENCLOSURES

(71) Applicant: Continental Automotive Systems, Inc., Auburn Hills, MI (US)

(72) Inventors: Wayne J Wright, Glenview, IL (US); Donald J Zito, Fox River Grove, IL (US); Vladimir Mulina, Chicago, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 79 days.

(21) Appl. No.: 14/338,674

(22) Filed: Jul. 23, 2014

(65) Prior Publication Data

US 2015/0064943 A1 Mar. 5, 2015

Related U.S. Application Data

(60) Provisional application No. 61/870,464, filed on Aug. 27, 2013.

(51) Int. Cl.
*H01R 9/20* (2006.01)
*H01R 9/18* (2006.01)
(Continued)

(52) U.S. Cl.
CPC ..... *H01R 12/71* (2013.01); *H01R 13/6594* (2013.01); *H01R 13/6596* (2013.01); *H01R 4/28* (2013.01)

(58) Field of Classification Search
CPC ..... H01R 12/71; H01R 13/6596; H01R 13/6594; H01R 4/28; H01R 4/30;
(Continued)

(56) References Cited

U.S. PATENT DOCUMENTS 7,186,590 B2 * 3/2007 Alcoe ..... H01L 23/10 257/704
8,027,164 B2 * 9/2011 Peck ..... H05K 7/142 361/730
(Continued)

FOREIGN PATENT DOCUMENTS

CN 2066010 U 11/1990
CN 101630663 A 1/2010
(Continued)

OTHER PUBLICATIONS

Chinese Office Action dated Feb. 4, 2017 for corresponding Chinese application No. 20140426470.4.
(Continued)

*Primary Examiner* — Edwin A. Leon
*Assistant Examiner* — Matthew T Dzierzynski

(57) ABSTRACT

An attachment structure for use with a standalone control unit. The control unit includes a threaded insert located in an enclosed cavity which allows screws to be used for grounding of an EMI/RFI board, along with creating a sealed, enclosed pocket. The attachment structure allows for grounding of the PCB to the sheet metal base plate without creating a leak path to the outside of the control unit. This ground approach encapsulates the screw to prevent the formation of a leak path.

23 Claims, 3 Drawing Sheets

(51) Int. Cl.

| | |
|---|---|
| ***H01R 12/71*** | (2011.01) |
| ***H01R 13/6594*** | (2011.01) |
| ***H01R 13/6596*** | (2011.01) |
| *H01R 4/28* | (2006.01) |

(58) Field of Classification Search
CPC . H01R 4/308; H01R 4/34; H01R 9/20; H01R 9/18; H01R 12/7047; H05K 1/021; H05K 1/142; H05K 1/182; H05K 2201/10401
See application file for complete search history.

(56) References Cited

U.S. PATENT DOCUMENTS 8,279,607 B2 * 10/2012 Horng ..... H01L 23/3677 165/185
8,933,347 B2 * 1/2015 Kiple ..... B23P 11/00 174/541
9,042,105 B2 * 5/2015 Malek ..... H05K 7/1417 361/748
9,106,011 B2 * 8/2015 Bengtsson ..... H01R 4/30
9,293,857 B2 * 3/2016 Baer ..... H01R 12/58
9,403,306 B2 * 8/2016 Akuta ..... B29C 45/14467
2001/0029120 A1 * 10/2001 Miyazaki ..... H01R 13/4223 439/98
2007/0117417 A1 * 5/2007 O'Brien ..... H05K 1/142 439/65
2008/0242160 A1 * 10/2008 Machet ..... H01R 4/5025 439/805
2010/0175811 A1 * 7/2010 Kumai ..... B29C 65/44 156/91
2012/0124936 A1 * 5/2012 Flaherty ..... E01C 5/20 52/747.11
2014/0165369 A1 * 6/2014 Chan ..... F16B 33/004 29/525.11
2014/0211432 A1 * 7/2014 Lozano ..... H05K 7/142 361/759
2015/0004851 A1 * 1/2015 Marcon ..... F16B 5/01 439/801
2015/0064989 A1 * 3/2015 Hirasawa ..... H01R 4/305 439/781
2016/0021730 A1 * 1/2016 Decker ..... H05K 1/18 361/720
2016/0273564 A1 * 9/2016 Bonicatto ..... H01R 12/7047

FOREIGN PATENT DOCUMENTS

| | | | |
|---|---|---|---|
| CN | 102537305 | A | 7/2012 |
| CN | 102792531 | A | 11/2012 |
| WO | 2012105875 | A1 | 8/2012 |

OTHER PUBLICATIONS

Second Chinese Office Action dated Oct. 23, 2017 for corresponding Chinese application No. 20140426470.4.

* cited by examiner

GROUNDING METHOD FOR BASEPLATE SEALED ENCLOSURES

CROSS-REFERENCE TO RELATED APPLICATIONS

This application claims the benefit of U.S. Provisional Application No. 61/870,464 filed Aug. 27, 2013. The disclosure of the above application is incorporated herein by reference.

FIELD OF THE INVENTION

The invention relates generally to an attachment structure for use with a standalone control unit having a sealed enclosure.

BACKGROUND OF THE INVENTION

Various types of control units are generally known. Some types of control units are standalone, and are designed to withstand operating in harsh environments. Standalone controllers use an aluminum sheet metal base plate to attach and provide a rigid support for a printed circuit board (PCB). A cover or housing is placed and sealed over a rigidizer creating a sealed PCB enclosure. It is difficult to ground the PCB for electromagnetic interface (EMI) and radio frequency interface (RFI) purposes because typical methods of using a screw create a leak path in the base plate. In addition, exposed screw threads through the bottom of the sheet metal base plate increase the risk of handling damage from the exposed screw threads.

Transmission control units (TCU) that are sealed and use an aluminum sheet metal base plate require a method of grounding the PCB to the base plate for EMI/RFI control. Any holes or screws in the base plate create a leak path which occurs typically during thermal cycles.

Accordingly, there exists a need for a standalone control unit which provides for a connection between a PCB and a base plate, and is also encapsulated and provides a proper seal.

SUMMARY OF THE INVENTION

The present invention is an attachment structure for use with a standalone control unit. A threaded insert in an enclosed cavity allows screws to be used for EMI/RFI board grounding along with creating a sealed, enclosed pocket.

The attachment structure of the present invention allows for grounding of the PCB to the sheet metal base plate without creating a leak path to the outside. The attachment structure is suitable for electrical grounding, and is not limited to use with grounding an EMI/RFI board. This grounding approach encapsulates the screw to prevent the formation of a leak path.

In one embodiment, the present invention is a transmission control unit having an attachment structure, which includes a base plate, a material layer disposed on at least a portion of a top surface of the base plate, and a printed circuit board at least partially disposed on the material layer.

A cavity is formed as part of the base plate, and an insert is located in the cavity such that at least a portion of the printed circuit board is supported by the insert. A screw is inserted through an aperture of the printed circuit board and an aperture of the insert, connecting the printed circuit board and the insert to the base plate. At least one protrusion is formed as part of the base plate in proximity to the insert, and at least one recess is formed as part of the insert, such that the protrusion extends into the recess to connect the insert to the base plate.

The cavity includes at least one side wall, and a bottom wall connected to the side wall. The protrusion is formed as part of the side wall.

There is also an axis, and the insert is non-circular, such that as the fastener is inserted through the insert and rotated, the insert is prevented from rotating about the axis and remains stationary relative to the base plate. At least part of the cavity is shaped to correspond to the shape of the insert, preventing rotation of the insert about the axis as the screw is inserted through the aperture of the insert and the aperture of the printed circuit board. At least a portion of the screw is substantially parallel to the axis.

The base plate is made of a metal material, such as aluminum, but it is within the scope of the invention that other types of metal may be used, such as, but not limited to, steel or copper.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
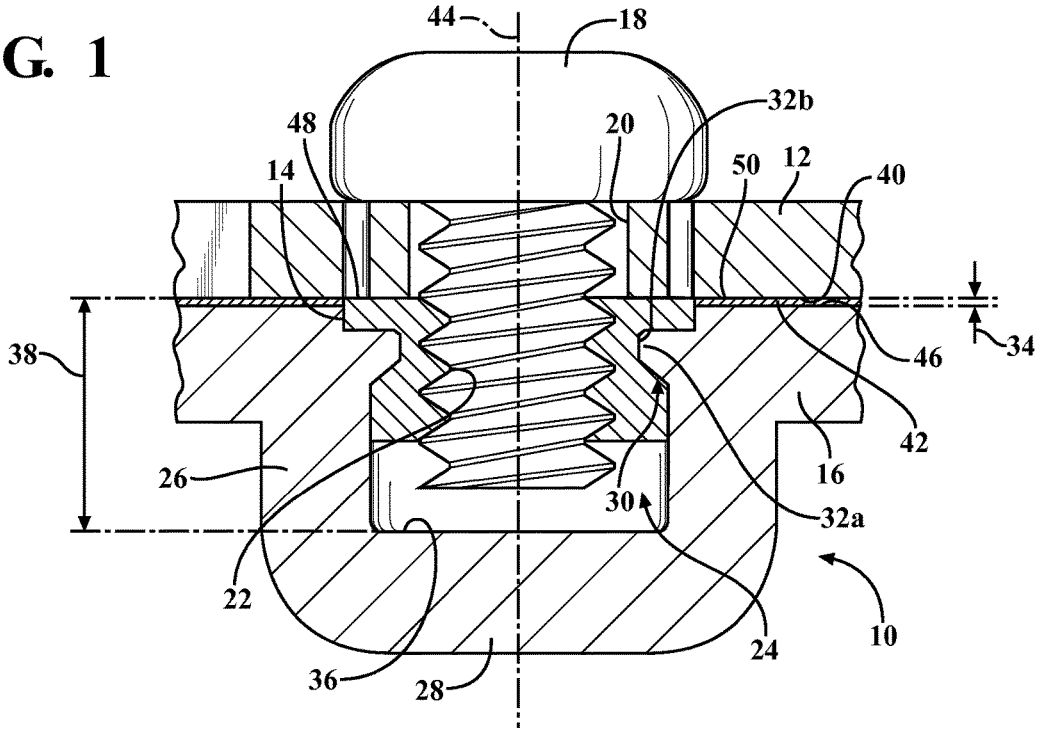
FIG. 1 is a sectional side view of an attachment structure for a standalone control unit, according to embodiments of the present invention.

The following description of the preferred embodiment(s) is merely exemplary in nature and is in no way intended to limit the invention, its application, or uses.

A section of a transmission control unit (TCU) having an attachment structure according to the present invention is shown in the Figures generally at 10. The TCU 10 includes a printed circuit board (PCB) 12, an insert 14, and a base plate 16. Also included is a fastener 18, which in this embodiment is a threaded screw, but it is within the scope of the invention that other types of fasteners may be used.

The screw 18 extends through a first aperture 20 formed as part of the PCB 12, and a second aperture 22 formed as part of the insert 14. There is an axis 44 which also extends through the first aperture 20 and the second aperture 22, and is substantially perpendicular to the PCB 12. The threaded portion of the screw 18 is inserted through the apertures 20,22 along the axis 44. The screw 18 is substantially parallel to the axis 44. The second aperture 22 is threaded and receives the screw 18 to secure the connection between the screw 18, the PCB 12, and the insert 14.

Figure 2:
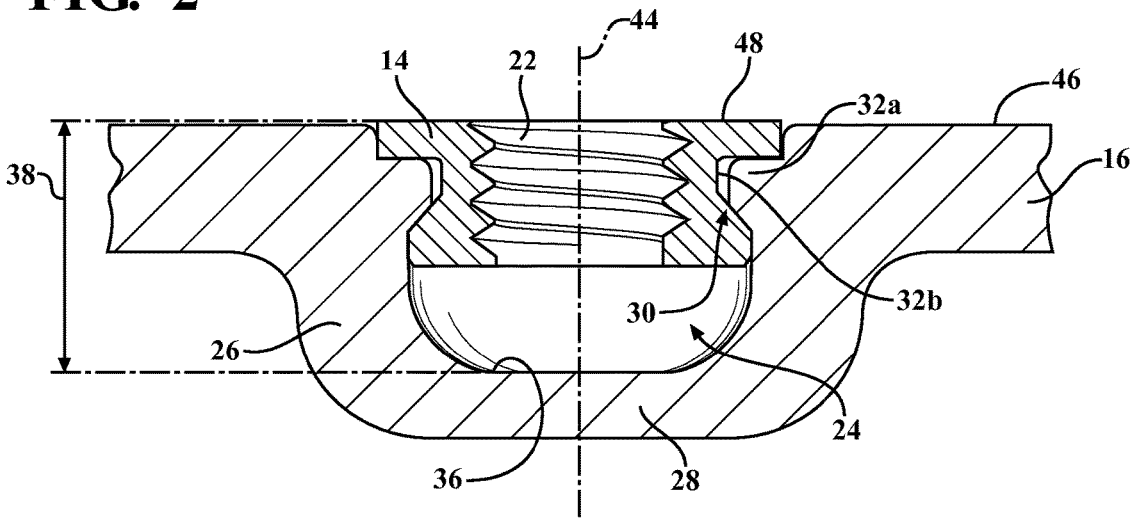
FIG. 2 is a sectional side view of an insert attached to a base plate, which is used as part of an attachment structure for a standalone control unit, according to embodiments of the present invention.
Figure 3:
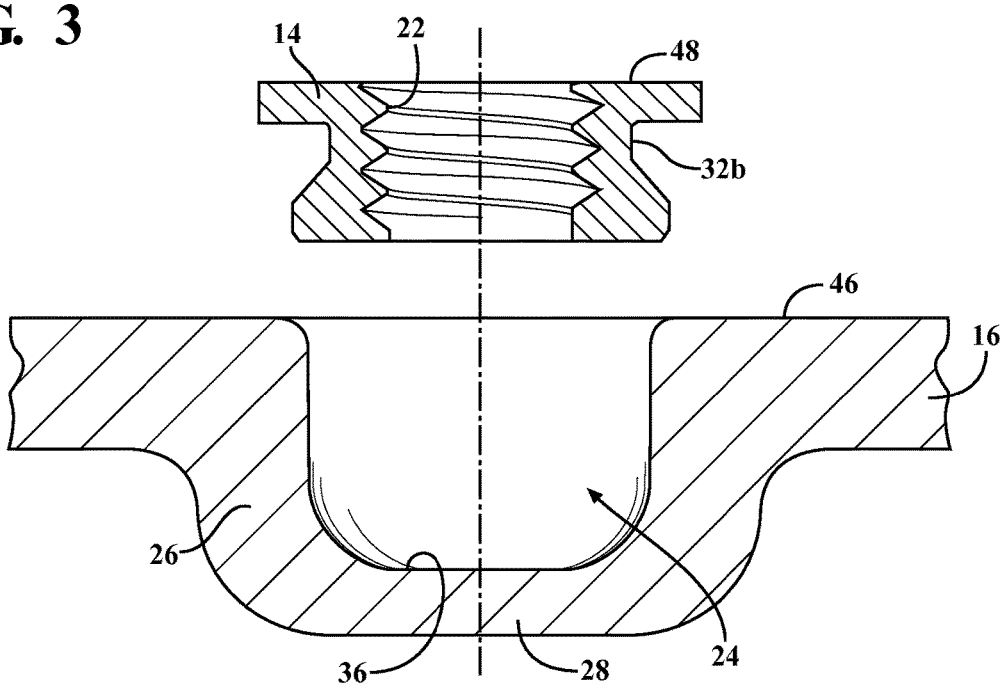
FIG. 3 is an exploded sectional side view of an insert and a base plate, prior to undergoing a swaging process, which are used as part of an attachment structure for a standalone control unit, according to embodiments of the present invention.

The insert 14 is also connected to the base plate 16 through the use of a retention feature, shown generally at 30. The base plate 16 includes a cavity, shown generally at 24, the insert 14 is located in the cavity 24, and the screw 18 partially extends into the cavity 24. The cavity 24 includes sidewalls 26 and a bottom wall 28. Integrally formed as part of the sidewalls 26 is a protrusion 32*a*, which is part of the retention feature 30 and circumscribes the sidewalls 26. The protrusion 32*a* extends into a recess 32*b* formed as part of the insert 14. The recess 32*b* circumscribes the insert 14, best shown in FIGS. 1-2, and 4, and is also part of the retention feature 30. The protrusion 32*a* is formed by a swaging process, and produces an interference fit between the protrusion 32*a* and the recess 32*b*, connecting the protrusion 32*a* and the recess 32*b*, and therefore properly positioning the insert 14 in the recess 32*b* relative to the base plate 16. The retention feature prevents the insert 14 from being removed from the cavity 24, and more specifically, from being pulled out of the cavity 24 due to the pulling force applied to the insert 14 as the screw 18 is inserted into the apertures 20,22.

The thickness of the insert 14 is such that the PCB 12 is not in contact with the base plate 16, but rather the thickness and positioning of the insert 14 locates the inner surface 40 of the PCB 12 at a distance 34 away from the top surface 46 the base plate 16. The distance 34 in this embodiment ranges from 0.13 mm to 0.30 mm, but it is within the scope of the invention that other distances may be used.

Located between the PCB 12 and the base plate 16 is a material layer 42. The material layer 42 is of a thickness approximately equal to the distance 34 between the inner surface 40 of the PCB 12 and the top surface 46 of the base plate 16. The material layer 42 is made of a thermal interface material which performs the functions of transferring heat away from the PCB 12, and the thermal interface material provides a dielectric isolation function.

The cavity 24 is formed as part of the base plate 16 such that the inner surface 36 of the bottom wall 28 is located at a distance 38 from the outer surface 48 of the insert 14. The location of the insert 14 is also such that the outer surface 48 of the insert 14 is also about the same distance 34 away from the top surface 46 of the base plate 16 as the lower surface 40 of the PCB 12. This ensures that the outer surface 48 of the insert 14 is in alignment with the outer surface 50 of the material layer 42, and therefore the PCB 12 is properly supported by the material layer 42 and the insert 14. The cavity 24 formed as part of the base plate 16 seals and encloses the entire area around the screw 18 and the insert 14, ensuring there is no leak path where liquid or other debris may enter the TCU 10.

Figure 4:
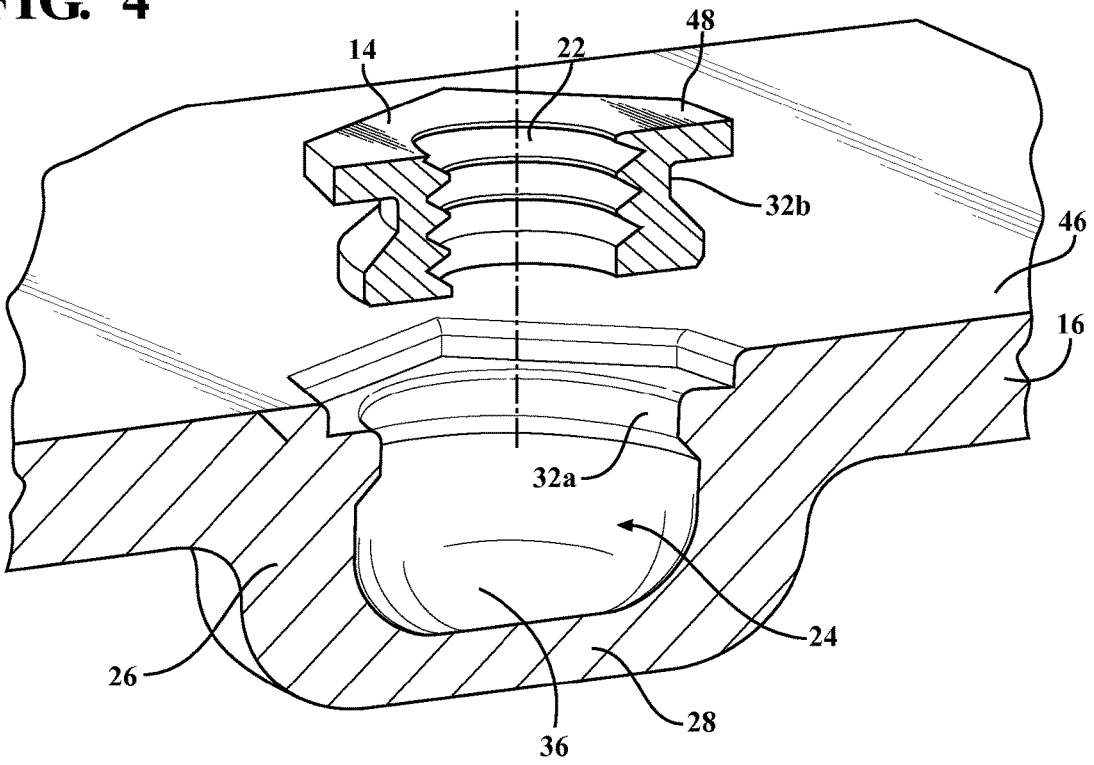
FIG. 4 is an exploded sectional side view of an insert shown separately from a base plate, after undergoing a swaging process, which are used as part of an attachment structure for a standalone control unit, according to embodiments of the present invention.
Figure 5:
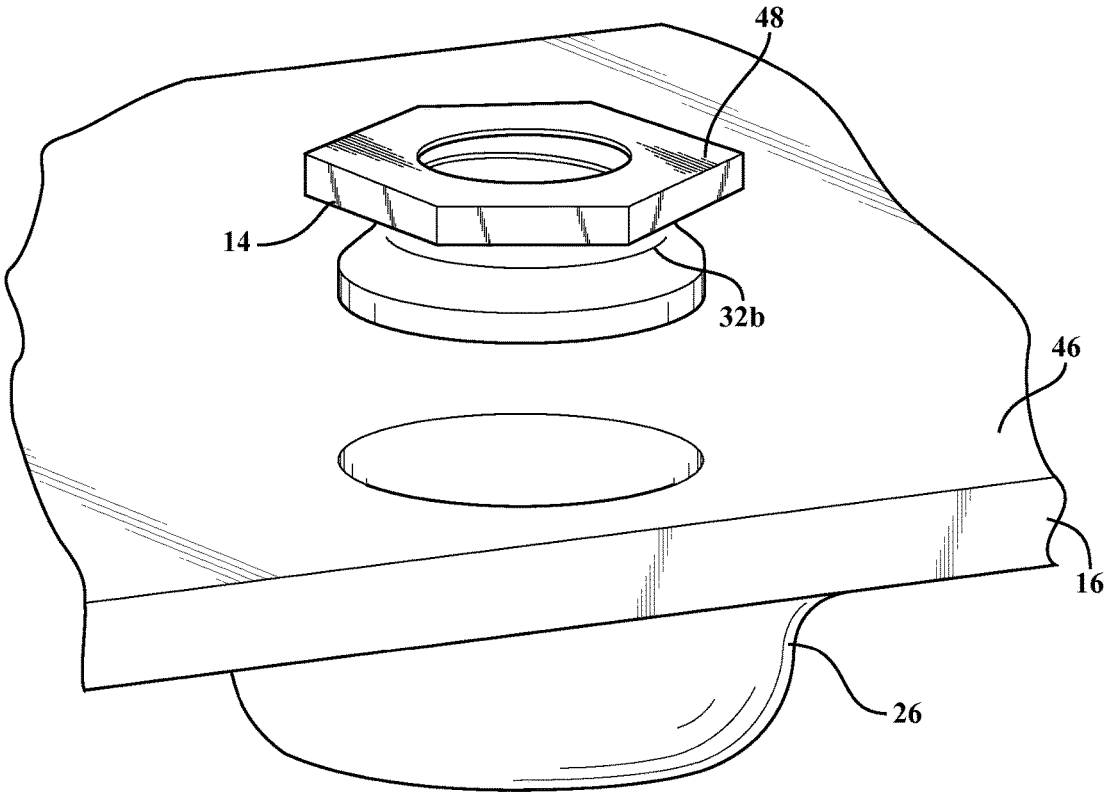
FIG. 5 is an exploded view of an insert and a base plate, prior to undergoing a swaging process, which are used as part of an attachment structure for a standalone control unit, according to embodiments of the present invention.

During assembly, the insert 14 is placed into the cavity 24, and the protrusion 32*a* is formed by the swaging process, as previously described, such that the protrusion 32*a* fits into the recess 32*b*. The insert 14 is a non-circular shape, and in this embodiment, the insert 14 is hexagonal in shape as shown in FIGS. 4-5, but it is within the scope of the invention that the insert may be other shapes as well, such as, but not limited to, triangular, rectangular, heptangular, and the like. The cavity 24, or at least the portion of the cavity 24 surrounding the insert 14, is of a shape that corresponds to the shape of the insert 14, which in this embodiment is hexagonal. After the insert 14 is placed in the cavity 24, and the swaging process is completed, the screw 18 is inserted through the first aperture 20 and is rotated, which then moves the screw 18 through the second aperture 22 of the insert 14. The hexagonal shape of the insert 14 and the corresponding hexagonal shape of the cavity 24 prevents the insert 14 from being rotated about the axis 44 relative to the base plate 16 as the screw 18 is inserted into the second aperture 22 and rotated.

Once the screw 18 is in place, the PCB 12 is connected to and positioned correctly relative to the base plate 16. The shape of the base plate 16, and more specifically the shape of the sidewall 26 and the bottom wall 28 creates the sealed cavity 24, and therefore prevents the existence of a leak path around the screw 18 and insert 14.

While it has been shown that the attachment structure of the present invention may be used with a TCU, it is within the scope of the invention that the attachment structure may be used with any other type of standalone controller, such as an electronic control unit, or the like. Furthermore, the base plate 16 shown in the drawings is made of aluminum, but it is within the scope of the invention that other types of materials may be used, such as steel, copper, or the like. The attachment structure of the present invention is also not limited to use with EMI/RFI board grounding, but it is within the scope of the invention that the attachment structure may be used to provide electrical grounding as well.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

an attachment structure, including:

a base plate having a top surface and a bottom surface;

an insert connected to the base plate, the insert including an upper portion having a non-circular outer shape defining a plurality of sides;

a retention feature connecting the insert to the base plate;

a circuit board having an inner surface positioned adjacent the base plate;

at least one fastener operable for connection with the insert; and a cavity formed as part of the top surface of the base plate and configured to receive the insert, the cavity having an upper section for receiving the upper portion of the insert, the upper section having a shape complementary to the non-circular shape of the outer portion, the cavity defining a depth from the top surface of the base plate to an inner surface of the bottom wall of the base plate;

wherein the at least one fastener is inserted through the circuit board, and through the insert such that a portion of the at least one fastener extends through the insert and into the cavity, securing the position of the circuit board relative to the base plate, the upper portion of the insert having a section extending away from the top surface of the base plate, the section of the upper portion positioning the inner surface of the circuit board at a first distance from the top surface of the base plate, the first distance being equal to the height of the upper portion, and wherein the depth of the cavity is less than a second distance between the inner surface of the circuit board and the bottom wall of the base plate.

2. The apparatus of claim 1, the retention feature further comprising:

a protrusion formed as part of the base plate; and a recess formed as part of the insert, such that the recess circumscribes the insert;

wherein the protrusion at least partially extends into the recess when the insert is connected to the base plate.

3. The apparatus of claim 2, further comprising:

at least one sidewall formed as part of the base plate such that the protrusion is formed as part of the at least one sidewall, the insert being adjacent the at least one sidewall; and a bottom wall formed as part of the base plate such that the at least one sidewall and the bottom wall form at least part of the cavity;

wherein at least a portion of the at least one fastener extends into the cavity towards the bottom wall when the at least one fastener is connected to the insert.

4. The apparatus of claim 3, further comprising:

an axis extending through the center of the insert;

wherein as the at least one fastener is inserted through the insert and rotated, the insert is prevented from rotating about the axis and remains stationary relative to the base plate.

5. The apparatus of claim 4, wherein at least part of the cavity is of a shape that corresponds to the shape of the insert, preventing rotation of the insert relative to the base plate when the at least one fastener is inserted into the insert.

6. The apparatus of claim 4, wherein the at least one fastener is positioned substantially parallel to the axis.

7. The apparatus of claim 1, the at least one fastener further comprising a screw.

8. The apparatus of claim 1, further comprising a material layer disposed between the circuit board and the base plate such that the material layer transfers heat away from the circuit board, and provides a dielectric isolation function for the circuit board.

9. The apparatus of claim 1, wherein the circuit board is a printed circuit board.

10. An attachment structure, comprising:

a base plate;

a cavity formed as part of the base plate, the cavity having a non-circular shape, the cavity having a depth;

at least one fastener;

an insert having at least one aperture for receiving the at least one fastener, the insert at least partially disposed in the cavity, the insert having a shape complementary to the non-circular shape of the cavity;

a retention feature connecting the base plate to the insert;

a material layer disposed on the base plate, the material layer defining a thickness; and a circuit board having an aperture, the circuit board partially supported by the material layer, and partially supported by the insert;

wherein the at least one fastener extends through the aperture formed as part of the circuit board, through the aperture formed as part of the insert such that a portion of the fastener extends through the insert and into the cavity, connecting the circuit board to the insert, and wherein the material layer transfers heat away from the circuit board and provides a dielectric isolation between the circuit board and the base plate, and wherein the thickness of the material layer equals a height of the portion of the insert extending away from the upper portion of the base plate.

11. The attachment structure of claim 10, the retention feature further comprising:

at least one protrusion integrally formed as part of the base plate, the at least one protrusion located in the cavity; and at least one recess integrally formed as part of the insert;

wherein the at least one protrusion is substantially disposed in the at least one recess when the insert is mounted in the cavity.

12. The attachment structure of claim 11, the cavity further comprising:

at least one sidewall, the insert adjacent the at least one sidewall; and a bottom wall connected to the at least one sidewall;

wherein the at least one protrusion is formed as part of the at least one sidewall.

13. The attachment structure of claim 10, further comprising an axis;

wherein at least portion of the insert is non-circular, such that as the at least one fastener is inserted through the aperture of the insert and rotated, the insert is prevented from rotating about the axis and remains stationary relative to the base plate.

14. The attachment structure of claim 13, wherein at least part of the cavity is shaped to prevent rotation of the insert about the axis as the at least one fastener is inserted through the aperture of the insert and the aperture of the circuit board.

15. The attachment structure of claim 13, wherein at least a portion of the at least one fastener is positioned substantially parallel to the axis.

16. The attachment structure of claim 10, wherein the base plate is made of a metal material.

17. An electronic control unit having an attachment structure, comprising:

a base plate having a top surface and a bottom surface;

a material layer disposed on at least a portion of the top surface of the base plate;

a printed circuit board at least partially disposed on and supported by the material layer, the printed circuit board having an inner surface positioned adjacent the base plate and defining an aperture;

a cavity formed as part of the base plate, the cavity defining a depth from the top surface of the base plate to an inner surface of the bottom wall of the base plate;

an insert located in the cavity such that at least a portion of the printed circuit board is supported by the insert, the insert having an aperture;

a screw inserted through the aperture of the printed circuit board and the aperture of the insert such that a portion of the screw extends through the insert and into the cavity, connecting the printed circuit board, the insert, and the base plate;

at least one protrusion formed as part of the base plate in proximity to the insert; and at least one recess formed as part of the insert;

wherein the at least one protrusion extends into the at least one recess to connect the insert to the base plate, wherein the material layer transfers heat away from the circuit board and provides a dielectric isolation between the circuit board and the base plate, and wherein the depth of the cavity is less than a distance between the inner surface of the circuit board and the bottom wall of the base plate.

18. The electronic control unit having an attachment structure of claim 17, the cavity further comprising:

at least one sidewall, the insert adjacent the at least one sidewall; and a bottom wall connected to the at least one sidewall;

wherein the at least one protrusion is formed as part of the at least one sidewall.

19. The electronic control unit having an attachment structure of claim 17, further comprising:

an axis;

wherein as the screw is inserted through the insert and rotated, the insert is prevented from rotating about the axis and remains stationary relative to the base plate.

20. The electronic control unit having an attachment structure of claim 19, wherein at least a portion of the screw is substantially parallel to the axis.

21. The electronic control unit having an attachment structure of claim 19, wherein the non-circular shape of the cavity prevents rotation of the insert about the axis as the screw is inserted through the aperture of the insert and the aperture of the printed circuit board.

22. The electronic control unit having an attachment structure of claim 17, wherein the base plate is made of a metal material.

23. The apparatus of claim 1, wherein the distance between the inner surface of the circuit board and the top surface of the base plate is between 0.13 millimeters and 0.30 millimeters.

* * * * *